US007303072B2

(12) United States Patent
Fuemmeler

(10) Patent No.: US 7,303,072 B2
(45) Date of Patent: Dec. 4, 2007

(54) NEWSPAPER COVER WITH ATTACHED SEALED PACKAGE AND PROCESS

(75) Inventor: Carl D. Fuemmeler, County of Boone, MO (US)

(73) Assignee: Mexico Plastic Company, Mexico, MO (US)

( * ) Notice: Subject to any disclaimer, the term of this patent is extended or adjusted under 35 U.S.C. 154(b) by 288 days.

(21) Appl. No.: 10/798,494

(22) Filed: Mar. 11, 2004

(65) Prior Publication Data

US 2004/0238394 A1 Dec. 2, 2004

Related U.S. Application Data

(60) Provisional application No. 60/474,803, filed on May 30, 2003.

(51) Int. Cl.
*B65D 85/00* (2006.01)
*B65D 30/22* (2006.01)
*B65B 43/04* (2006.01)

(52) U.S. Cl. ..... 206/410; 206/459.5; 206/831; 383/40

(58) Field of Classification Search ..... 206/389, 206/407, 410, 83.5, 223, 225, 232, 446, 831, 206/459.5; 383/40, 38; 229/87.09
See application file for complete search history.

(56) References Cited

U.S. PATENT DOCUMENTS

| | | | | |
|---|---|---|---|---|
| 1,541,167 | A * | 6/1925 | Mulvey | 383/40 |
| 3,762,628 | A * | 10/1973 | Sargent | 383/40 |
| 3,998,135 | A * | 12/1976 | Sargent | 493/216 |
| 4,065,049 | A | 12/1977 | Achelpohl et al. | |
| 5,738,263 | A | 4/1998 | Lewis | |
| 5,851,069 | A * | 12/1998 | Davoren | 383/40 |
| 6,234,673 | B1 | 5/2001 | Tonoff | |
| 6,609,613 | B2 * | 8/2003 | Schneider et al. | 206/232 |

* cited by examiner

*Primary Examiner*—Mickey Yu
*Assistant Examiner*—J. Gregory Pickett
(74) *Attorney, Agent, or Firm*—Polster, Leider, Woodruff & Lucchesi, P.C.

(57) ABSTRACT

A plastic newspaper cover having an attached package overlay with the package containing an item such as advertisements, coupons, samples, notices, etc. The cover or sleeve and package are formed from folded thin polymeric heat-sealable sheets which are overlaid that may be simultaneously cut and heat-sealed into the final shape.

4 Claims, 2 Drawing Sheets

NEWSPAPER COVER WITH ATTACHED SEALED PACKAGE AND PROCESS

CROSS REFERENCE TO RELATED APPLICATIONS

This application is related to U.S. Provisional Patent Application 60/474,803 filed May 30, 2003 from which priority is claimed.

FIELD OF THE INVENTION

This invention relates to plastic newspaper covers, and more particularly, to thin plastic covers for newspapers which have advertising printed on the outer surfaces thereof with a sealed attached package designed to hold coupons, flat-pack samples, and the like.

BACKGROUND OF THE INVENTION

For many years newspapers were simply rolled and bound by wire or string before being thrown onto customers' lawns, porches or driveways. With the advent of thin film plastics, it became customary to fold or roll the newspaper and to enclose the folded or rolled newspaper in a sleeve of plastic before being thrown onto the customer's property. The plastic film had the advantage of protecting the paper from rain, snow, etc. The thin film plastic packages may be clear, colored, and in some instances have advertising printed on the package walls. It is also common place to distribute advertising flyers including coupons in newspapers and by direct mail. Samples of products also are distributed by direct mail.

SUMMARY OF THE INVENTION

This invention is embodied in a thin plastic sleeve for distributing newspapers. A sealed package is attached to the sleeve adjacent to one end thereof with the package adapted to contain coupons, product literature, flat pack samples and the like. The invention also embodies the process for making the sleeve and package.

DESCRIPTION OF THE DRAWINGS

In the drawings wherein like numbers and letters refer to like parts wherever they occur.

DETAILED DESCRIPTION OF INVENTION

Figure 1:
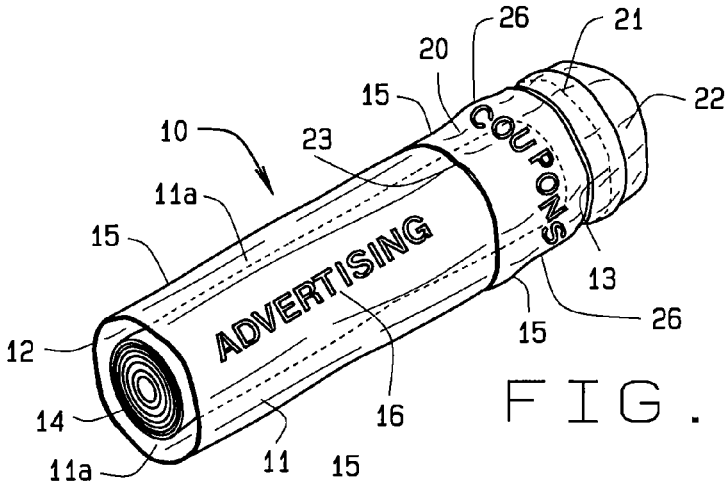
FIG. 1 is a perspective view of one embodiment of the present invention showing a rolled newspaper enclosed in the sleeve of this invention.
Figure 3:
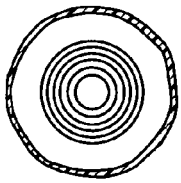
FIG. 3 is a sectional view taken along line 3-3 of FIG. 2.
Figure 4:
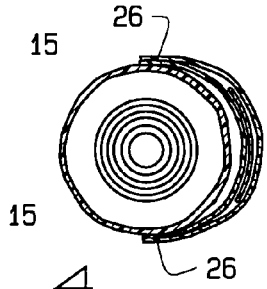
FIG. 4 is a sectional view taken along line 4-4 of FIG. 2.
Figure 5:
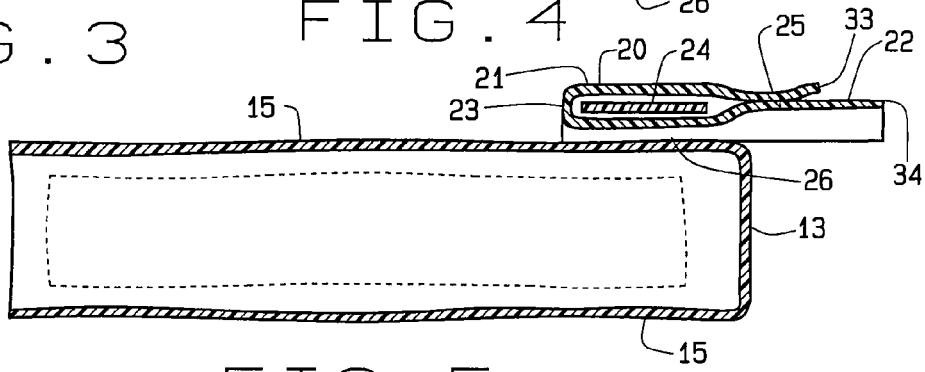
FIG. 5 is a sectional view taken along line 5-5 of FIG. 2.

FIG. 1 shows one embodiment of the present invention. In that embodiment, a combined newspaper cover and attached package 10 comprises a sleeve 11 which has an open end 12 and a closed or sealed end 13 formed by the fold 13 of the folded over sides 11*a* of the sleeve 11. In one use of the present embodiment, a rolled newspaper 14 is positioned inside the sleeve 11 as shown in FIG. 3 and FIG. 4.

Attached to the sleeve 11 along the side edges 15 and adjacent to the closed end 13 is a sealed package 20. The package 20 comprises a top layer 21 and a bottom layer 22 which are folded over each other to form a closed end 23 which overlays the sleeve 11. Inside the package 20, which may be made of clear plastic, is an item 24 that may be a coupon, sample game piece, product literature, gift certificate, invitation, flat-pack sample, advertising entry form, advertising sample giveaway, notices, or other form of advertising or communication material.

The package 20 is heat sealed at 25 to seal the item 24 inside. The package 20 is attached to the sleeve 11 only along the side edges 15. It is understood that in the present embodiment, the distance between the closed end 23 and the end 33 of the top layer 21 is less than the distance between the closed end 23 and the end 34 of the bottom layer 22. This variation in distances generates an offset between the end 33 and the end 34 and thereby provides a grip for opening the package 20.

Printed on the outside of the sleeve 11 is advertising indicia 16 which can be on one or both sides. The side edges 26 (FIG. 4) of the package compartment 20 may be heat-sealed to the sleeve 11 along the side edges 15.

Figure 6:
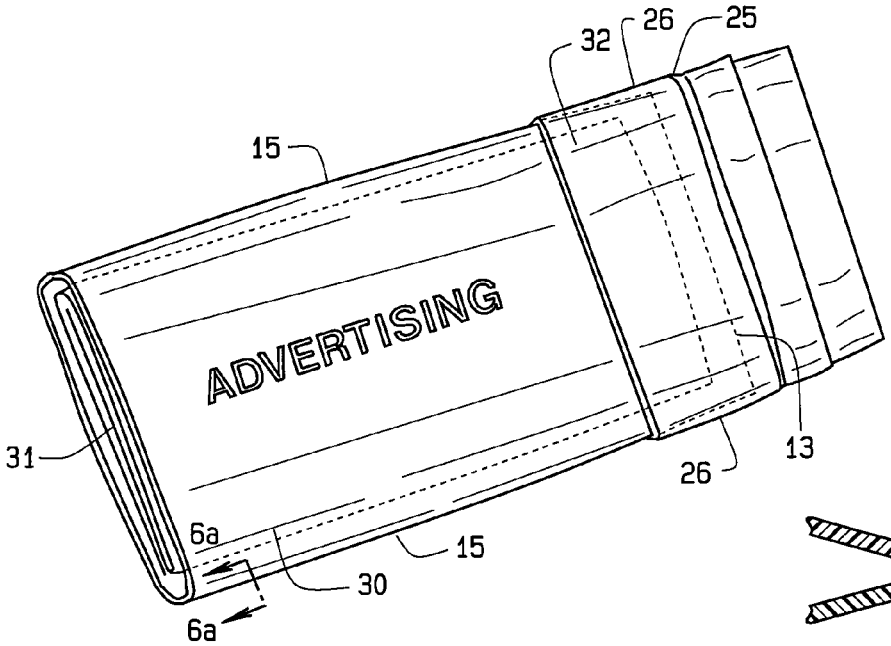
FIG. 6 is a perspective view of a folded newspaper enclosed in the sleeve of one embodiment of the present invention.
Figure 6A:
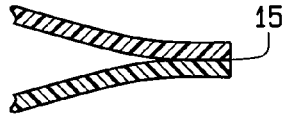
FIG. 6*a* is a partial side elevational view of a seam at an edge portion of the sleeve.

FIG. 6 shows a modification of the invention in which the sleeve 30 is flat and the newspaper 31 is merely folded and inserted into the sleeve 30. The product compartment 32 also is flat. This construction accommodates larger and bulkier samples, coupons, etc. It will be appreciated that the overall length of the product compartment 32 may be adjusted to accommodate any size of the item 24 that may be placed within the product compartment 32 and still remain within the scope of the present invention. In some instances, for example, the closed end 23 of the product compartment may be adjusted such that the closed end 23 is at or close to the overall length of the sleeve 11.

Figure 2:
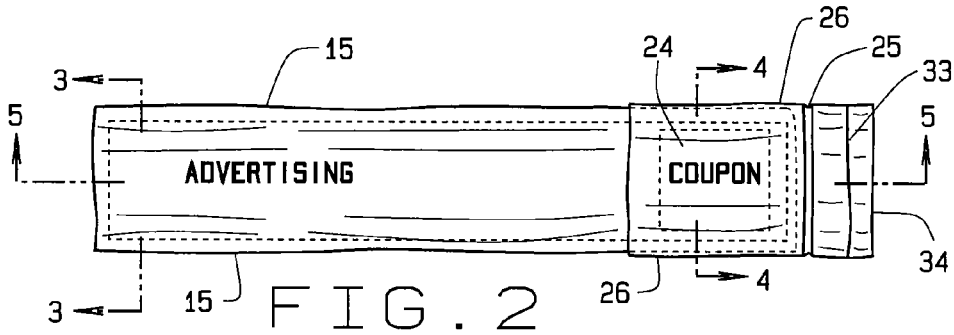
FIG. 2 is a detailed side elevational view of the sleeve of FIG. 1.
Figure 7:
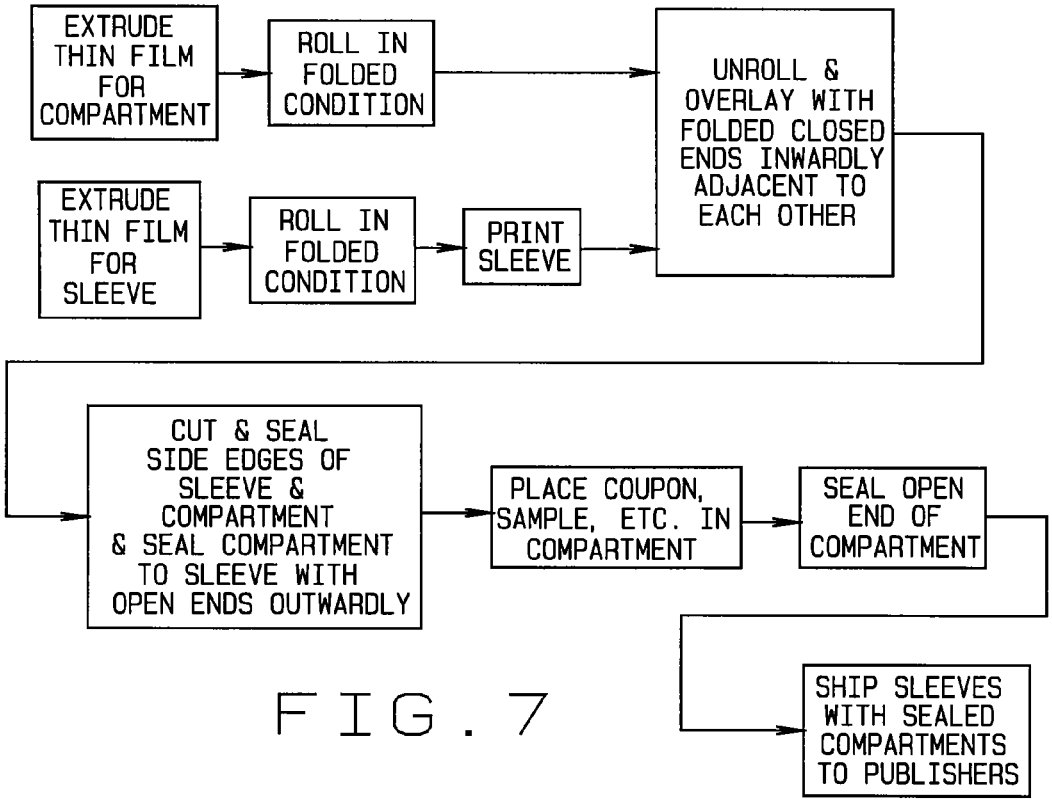
FIG. 7 is a diagrammatic block diagram of a process of making the sleeve and package compartment of one embodiment of the present invention.

FIG. 7 shows a flow diagram of the process for making this invention. The sleeve 11 (FIG. 2) is first extruded as a single sheet of thin plastic. This is folded lengthwise and the folded sheet is placed onto a roll. The compartment 20 likewise is a single sheet of thin extruded plastic film which also is folded before being placed on a roll. The rolls are stored until needed.

In the present embodiment, when an order is received, the sleeve 11 is printed with advertising indicia and the folded sleeve 11 and the folded compartment 20 are unrolled, with the compartment 20 overlying the sleeve at the closed end 13. The closed end 23 of the package compartment 20 and the closed end 13 of the sleeve 11 are adjacent to each other so that the sleeve open end 12 and the compartment 20 open end are positioned away from each other. To form the combined sleeve and attached package 10, a hot knife is used to simultaneously sever and seal the sleeve side edges 15 and the compartment side edges 26. This also simultaneously heat-seals the compartment 20 to the sleeve 13 along the side edges 26. The item 24 is then placed into the compartment 20 and the end of the compartment 20 is heat-sealed at 25 to close the end of the compartment. The completed package then is shipped to the publisher, distributor, etc., where the newspaper is placed in the sleeve 11 and the package 10 is distributed to the homeowners.

In alternative embodiments, the sleeve 11 and package 10 may be assembled and stored until an order is received. In this case, the sleeve 11 is then printed and the item 24 is inserted into the open compartment 20 which is then heat-sealed before being shipped to the publisher, printer, etc.

Although various pliable and heat-sealable materials may be used in the present invention, in the current embodiment, the sleeve 11 and compartment 20 preferably are formed from linear low density heat-sealable polymer or low density polyethylene of about 1 to about 1.5 mil thickness.

In view of the above, it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense.

What is claimed is:

1. A multi-compartment package formed from at least a first and second folded sheet of thin heat sealable polymeric material with the sheets being juxtaposed over one another and with the folded ends of the sheets being directed toward each other to form closed ends of first and second compartments, the sheets being heat sealed to one another along their side edges to seal the sides of the compartments and to attach the compartments to each other, the ends of the first folded over sheet opposite the folded end being free to accept items placed in the first compartment, the ends of the second folded over sheet being free and spaced outwardly from the folded over end of the first sheet, an item positioned in the second compartment, and a heat seal located between the free ends of the second folded over sheet and the folded over end of the first sheet to seal the item in the second compartment.

2. The multi-compartment package of claim 1 wherein the first compartment is adapted to contain a newspaper.

3. The multi-compartment package of claim 1 including advertising indicia on an outside surface of the first compartment.

4. The multi-compartment package of claim 1 wherein the package insert is advertising matter.

* * * * *